US006033053A

United States Patent [19]

Eun

[11] Patent Number: 6,033,053

[45] Date of Patent: Mar. 7, 2000

[54] INK-JET PRINTER WITH A DRUM CARTRIDGE HAVING A PLURALITY OF HEADS

[75] Inventor: Jong-Moon Eun, Suwon, Rep. of Korea

[73] Assignee: SamSung Electronics Co., Ltd., Kyungki-do, Rep. of Korea

[21] Appl. No.: 08/933,337

[22] Filed: Sep. 18, 1997

[30] Foreign Application Priority Data

Sep. 18, 1996 [KR] Rep. of Korea ..... 96-40651

[51] Int. Cl.[7] ..... B41J 2/01

[52] U.S. Cl. ..... 347/38

[58] Field of Search ..... 347/38, 87, 42; 346/140.1

[56] References Cited

U.S. PATENT DOCUMENTS

| | | | |
|---|---|---|---|
| 3,640,214 | 2/1972 | Scheinhutte . | |
| 4,555,717 | 11/1985 | Miura et al. . | |
| 4,580,148 | 4/1986 | Domoto et al. | 347/42 X |
| 4,714,936 | 12/1987 | Helinski et al. . | |
| 4,769,654 | 9/1988 | Tanaka et al. . | |
| 4,785,311 | 11/1988 | Kaneko et al. . | |
| 4,855,768 | 8/1989 | Iino et al. . | |
| 5,322,594 | 6/1994 | Bol | 347/65 X |
| 5,465,108 | 11/1995 | Fujimoto . | |
| 5,509,058 | 4/1996 | Fishbeck . | |
| 5,552,812 | 9/1996 | Ebinuma et al. | 347/42 X |
| 5,760,808 | 6/1998 | Wiedemer | 346/140.1 X |

FOREIGN PATENT DOCUMENTS

| | | | |
|---|---|---|---|
| 0 556 045 A2 | 8/1993 | European Pat. Off. . | |
| 0 600 712A2 | 6/1994 | European Pat. Off. . | |
| 5-124182 | 5/1993 | Japan | B41J 2/01 |
| WO 95/29063 | 11/1995 | WIPO . | |

OTHER PUBLICATIONS

Patent Abstracts of Japan, vol. 018, No. 025 (M–1542), Jan. 14, 1994 & JP 05 261906 (Fujitsu Ltd.) Oct. 12, 1993.

Patent Abstracts of Japan, vol. 009, No. 114 (M–380), May 18, 1985 & JP 60 000972 A (Nozaki Insatsu Shigyo KK), Jan. 7, 1985.

Patent Abstracts of Japan, vol. 017, No. 537 (M–1487), & JP 05 147284 A (Mita Ind Co Ltd), Jun. 15, 1993.

*Primary Examiner*—N. Le
*Assistant Examiner*—Anh T. N. Vo
*Attorney, Agent, or Firm*—Robert E. Bushnell, Esq.

[57] ABSTRACT

A drum cartridge with a plurality of heads for use with an ink-jet printer. This inventive cartridge increases the speed of printing and the resolution of the printed matter. The drum cartridge moves in a rotational fashion rather than in the typical reciprocating rectilinear fashion used by typical ink-jet cartridges.

28 Claims, 5 Drawing Sheets

INK-JET PRINTER WITH A DRUM CARTRIDGE HAVING A PLURALITY OF HEADS

CLAIM OF PRIORITY

This application makes reference to, incorporates the same herein, and claims all rights accruing thereto under 35 U.S.C. §119 through my patent application entitled *Ink-Jet Printer with Drum Head* earlier filed in the Korean Industrial Property Office on the 18th day of September 1996 and there duly assigned Ser. No. 1996/40651.

BACKGROUND OF THE INVENTION

1. Field of the Invention

This invention relates to printer cartridges and, more specifically, to a drum ink-jet printer cartridge, having a plurality of printing heads, that operates in a rotary rather than a rectilinear manner.

2. Background Art

With the greater amounts of information being generated by computers, the development of printer technology has become increasingly important. One popular type of printer is the ink-jet printer. There are two types of ink-jet printers, the continuous jet type and the drop on demand type of ink jet printer. The continuous ink-jet printers project a continuous spray of ink drops from a small nozzle toward a recording medium. In contrast, the drop on demand ink-jet printers release droplets in response to signals from a controller. The controller causes changes in the pressure within the ink storage chamber of the printer cartridge resulting in a succession of droplets being ejected. Many advancements have been made in ink-jet technology due to continuing efforts to increase printer speed and to improve the resolution of printed images. By way of example, U.S. Pat. No. 4,714,936 to Helinski entitled *Ink-Jet Printer*, mentions an ink-jet printer with a rotary print head. U.S. Pat. No. 4,769,654 entitled *Ink-Jet Printing Head Having Plurality of Ink-Jetting Units Disposed Parallel to Circular Shaped Reference Plane*, discloses a specific multi-nozzle configuration for an ink-jet printer head. Also disclosing a multi-nozzle array, is U.S. Pat. No. 5,465,108 to Fujimoto entitled *Ink-Jet Print Head and Ink-Jet Printer*. U.S. Pat. No. 4,555,717 to Miura entitled *Ink-Jet Printing Head Utilizing Pressure and Potential Gradients*, discusses using both electrical field pressure gradients and air-jet pressure gradients to separate droplets from the ink in the cartridge.

I have observed that what is needed, but so far unaddressed, by the art is an ink-jet printer head that has a drum shape, that is capable of producing resolution exceeding 300 dots per inch, that is operated in a rotary rather than rectilinear fashion, that does not require mechanisms for rectilinear reciprocating motion, that has a plurality of ink-ejecting orifices, and is capable of increasing the print speed of the typical ink-jet printer. I expect that such a printer head will enhance the usefulness of the typical ink-jet printer and increase the number of applications for which it is suitable.

SUMMARY OF THE INVENTION

It is an object of the present invention to provide an ink-jet printer with a drum printer cartridge that is capable of producing resolution exceeding 300 dpi as the cartridge rotates.

It is another object to provide an ink-jet printer which uses a drum cartridge that rotates rather than moving in a rectilinear reciprocating motion during printing.

It is still another object to produce an ink-jet printer with a drum cartridge that allows for further miniaturization of the printer, due to not needing the typical mechanisms used to generate the cartridge's rectilinear reciprocating motion.

It is yet another object provide an ink-jet printer with a drum cartridge that is capable of increased print speed.

To achieve these and other objects, the ink-jet printer uses a drum cartridge having a plurality of printing heads to print images on paper while operating in a rotary rather than rectilinear fashion. The printing heads on the drum cartridge may be constructed using a nozzle-plate with ejection orifices for ejecting ink onto paper; a reservoir for storing ink inside the printing head; a resistive element that heats the ink in the head and creates vapor pressure; first and second electrodes that provide energy to the resistive element; a slot for drawing the ink from the ink storage chamber in the cartridge into the reservoir in the printing head.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
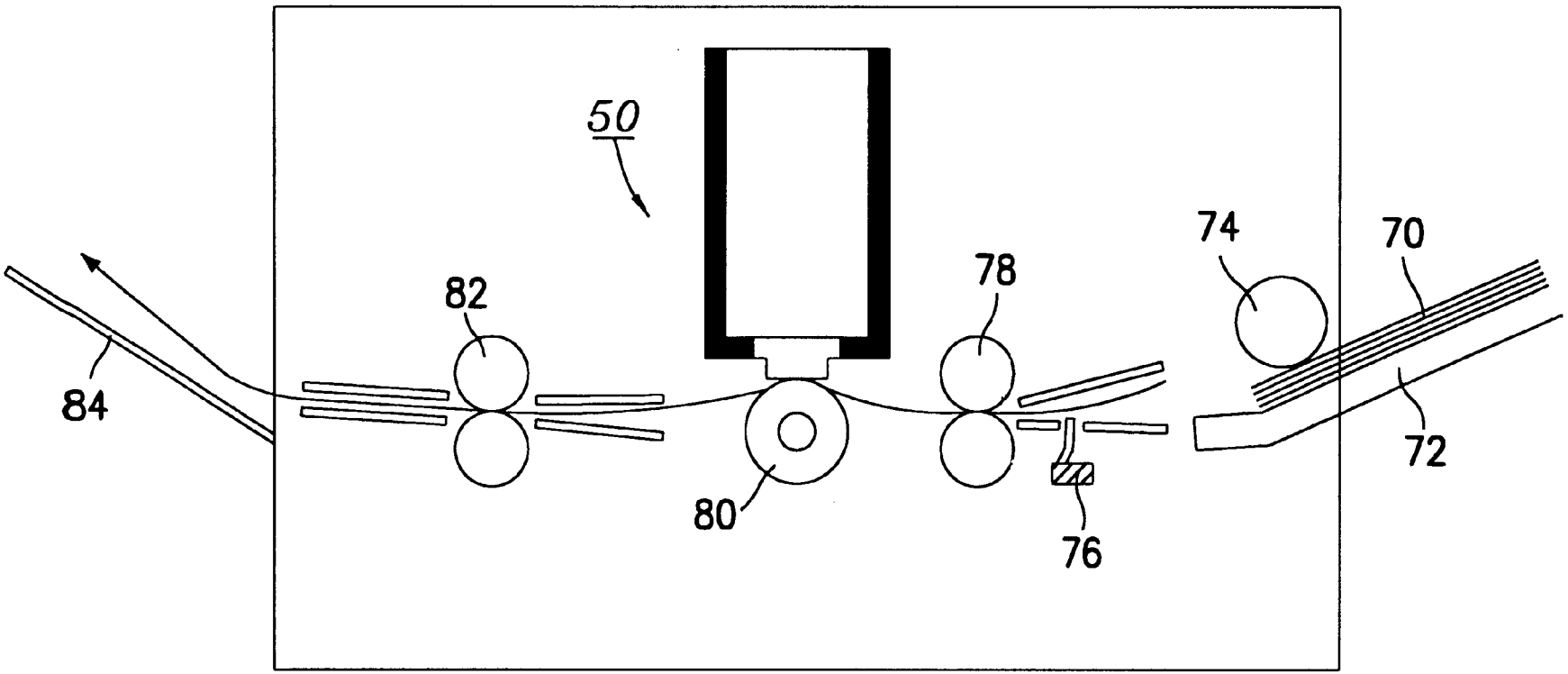
FIG. 1 is a schematic illustration of a typical ink-jet printer.
Figure 3:
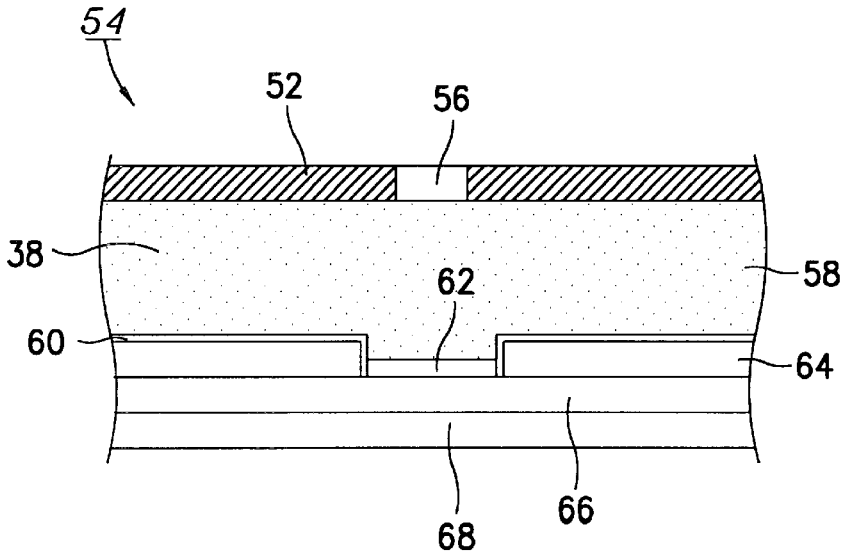
FIG. 3 is a cross sectional view of a typical head of an ink-jet printer cartridge.

Turning now to the drawings, FIG. 1 illustrates a schematic view of the configuration of a typical ink-jet printer. The printer has a tray 72 that holds paper 70 and a paper feed roller 74, that is installed above the leading edge of the paper tray 72. The paper feed roller loads the paper into the printer. A sensor 76 is installed at one side of paper feed roller 74 to coordinate the paper feed roller 74 and the transfer roller 78. The transfer roller 78 is used to transfer the paper 70 to the ink cartridge 50 that contains the printing head unit 54 (FIG. 3). The ink cartridge undergoes a rectilinear reciprocating motion that is driven by a motor (not shown) installed beside transfer roller 78. The platen roller 80 is installed below the ink cartridge 50 and continues to transfer the paper 70 while the printing head is printing on it. Then the paper discharge roller 82 discharges the printed paper to stacker 84.

Figure 2:
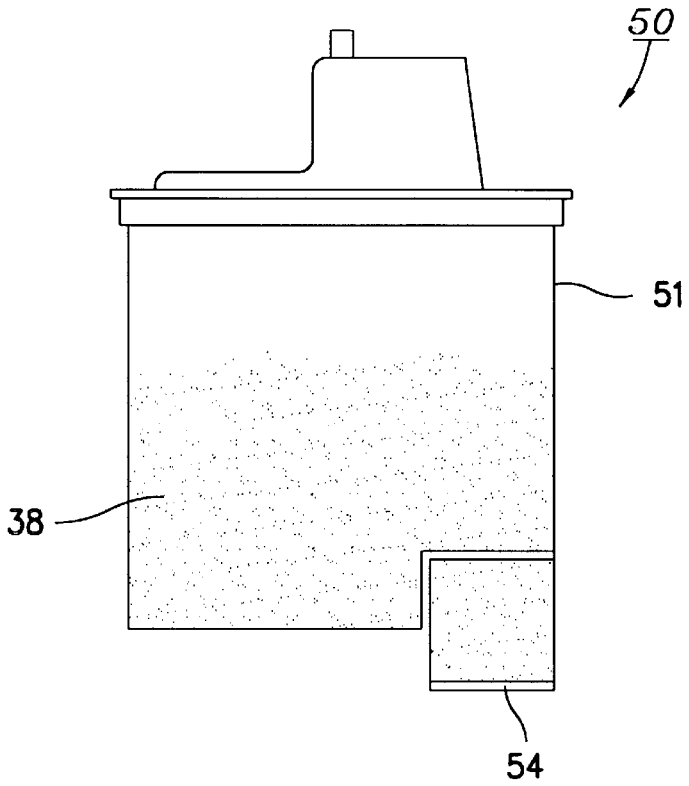
FIG. 2 is a side view of a typical cartridge used in an ink-jet printer.

As shown in FIG. 2, cartridge 50 consists of an ink container 51, which stores the ink 38, and a head 54. FIG. 3 illustrates the configuration of the printing head 54. The ink 38 is ejected from the ejection orifice 56 that is located in the printing head plate 52. A reservoir 58 in the printing head provides ink 38 to the ejection orifice. A resistive heating element 62 is installed in the bottom of the ink reservoir 58 that heats and evaporates the ink 38 to create vapor pressure inside the reservoir. Electrodes 64 are installed on both sides of the heating element 62 thereby supplying energy to the heating element. Substrate layer 68 is made of silicon. A resistor layer 66 insulates the electrodes 64 and is installed below the electrodes 64. A protective film 60, formed on the electrodes 68, protects the electrodes 64, the heating element 62, and the resistor layer 66 from corrosion and oxidation reactions with the ink.

The operation of the ink-jet printer with a cartridge that follows a rectilinear reciprocating motion during printing, is as follows. Once the printer is switched "on" paper 70 from the paper tray 72 is transported by the paper feed roller 74. The paper feed roller 74 stops after a specified period of time depending on its distance from the transfer roller 78. The paper is then fed to the printer cartridge 50 by the transfer roller 78. The printing head 54 prints on the paper while the paper is being transported past the cartridge. Once the control unit sends a print command to printer head 54, a voltage is applied to electrodes 64. Heating element 62 is given energy from the electrodes 64 and the heating element then evaporates the nearby ink and creates a gas bubble in the reservoir. Ink in the reservoir 58 is propelled by vapor pressure and sprayed onto the paper through the ejection orifice 56, thus forming the desired letters or pictures. Platen roller 80 fixes the image to the paper using a voltage between 500 and 5000 V. The paper is then transferred to a paper receiving tray 84 by the paper discharge roller 82.

The typical ink-jet printer head 54 is installed in a serial matrix configuration that prints using a rectilinear reciprocating motion. Controlling the reciprocating motor to maintain resolution exceeding 300 dots per inch (dpi) requires complex technology as well as a mechanism to guide the rectilinear reciprocating motion of head 54. Serial printer heads following a rectilinear reciprocating motion are also limited in their printing speed. Special mechanisms can be installed to increase their printing speed, but this makes the printers very large and bulky.

Figure 4:
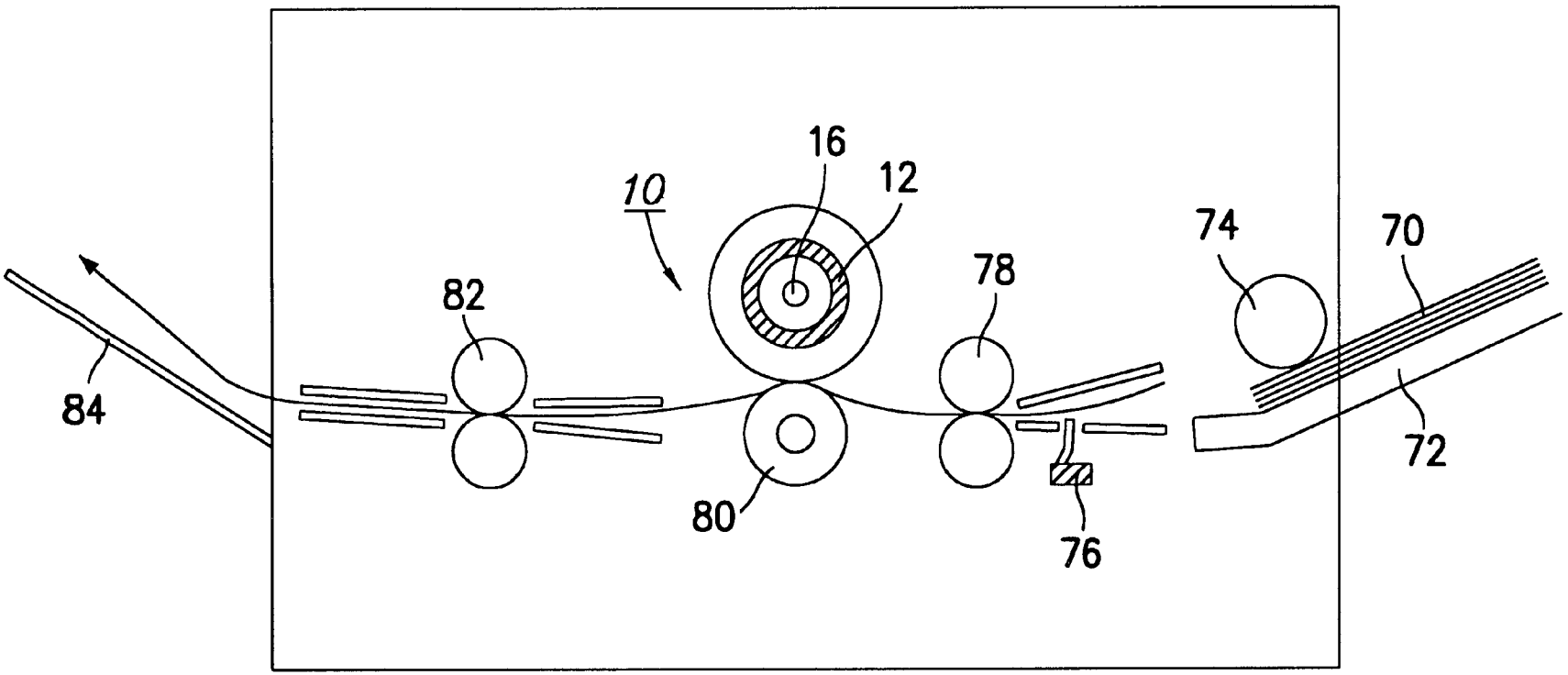
FIG. 4 is a schematic illustration of an ink-jet printer using a drum cartridge constructed in accord with the preferred embodiment.

FIG. 4 shows an ink-jet printer using the a drum cartridge constructed according to the preferred embodiment. The drum cartridge 10 rotates on a shaft 16 and is installed beside the transfer roller 78. The platen roller 80 is installed under the drum cartridge 10 to fix the toner image to the paper using a large voltage.

Figure 5:
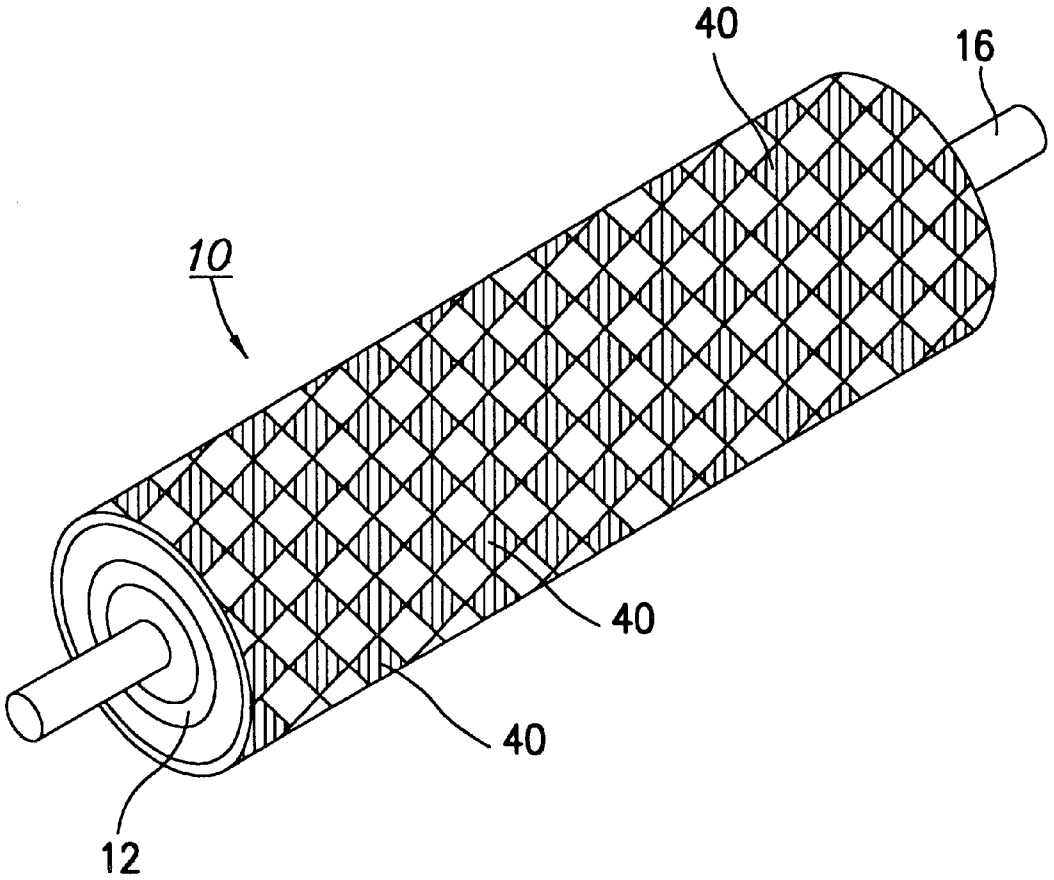
FIG. 5 is a perspective view of the drum cartridge shown in FIG. 4.
Figure 6:
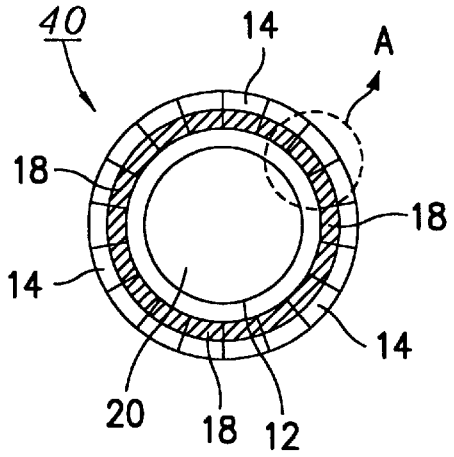
FIG. 6 is a cross sectional view of the drum cartridge shown in FIG. 4.
Figure 7:
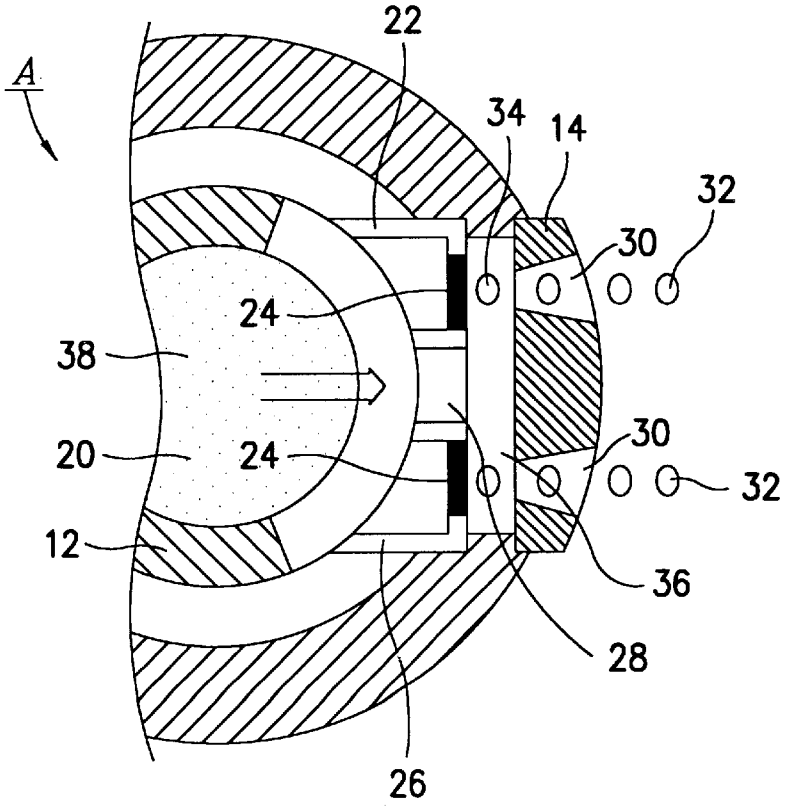
FIG. 7 is an exploded view of the area "A" FIG. 6.

As shown in FIG. 5, the surface of the drum cartridge 10 has multiple printing heads 40 that print images onto paper in accordance with electric signals sent from the control unit. One or more lines of printer heads 40 can be arranged in a spiral, or oblique helix formation on the cartridge, thus creating a checker pattern. A single printing head 40 may consist of a nozzle-plate with ejection orifices for ejecting ink onto paper; a reservoir for storing ink inside the printing head; a resistive element that heats the ink in the head and creates vapor pressure; first and second electrodes that provide energy to the resistive element; a slot for drawing the ink from the ink storage chamber in the cartridge into the reservoir in the printing head. As shown in FIGS. 6 and 7, the printing head's 40 nozzle plate 14 has ejection orifices 30 for ejecting bubbles 34 of ink from the reservoir 38 onto a sheet of paper. Two or more ejection orifices 30 can be used in each nozzle plate 10 to increase the print speed.

Resistive heating elements 24 are installed along one edge of the reservoir 36 to create vapor pressure and gas bubbles 34 by heating the ink 38. First and second electrodes 22 and 26 are installed on both sides of each resistive heating element 24 to provide in a voltage to them. The slot 28 between resistor portions 24 draws ink 38 from the ink storage chamber in the cartridge toward the parts of the reservoir 36 where the resistor units 24 are installed. The first and second electrodes, 22 and 26, and the resistive heating elements 24 are installed on a substrate layer 12, which is made of silicon. A chamber 20 is created inside the substrate layer 12.

The operation of the ink-jet printer with the drum cartridge having such is as follows Paper 70 from the paper tray 72 is loaded into the printer by the paper feed roller 74. The paper is then transferred to the drum cartridge 10 by the transfer roller 78. The drum cartridge 10 starts printing on the paper while rotating in a specified direction. Once the control unit sends a print command to a head 40, its first and second electrodes 22 and 26 are given a voltage that results in the resistive elements generating heat. At the same time, ink 38 stored in the ink storage chamber 20 in the cartridge flows into the reservoir 36 through the slot 28 between the sets of electrodes. Then the ink 38 near the resistive heating elements 24 is evaporated and forms gaseous bubbles 34 that cause ink droplets to be ejected ejected, through the ejection orifices 30, onto a sheet of paper in the form of dots 32, thus forming letters or pictures. The platen roller 80 in FIG. 4 fixes the image to the paper with a voltage between 500 and 5000 V. The printed paper is transferred to paper receiving tray 84 by paper discharge roller 82.

As described above, the ink-jet printer with a drum cartridge produces images having a resolution exceeding 300 dpi because the printing heads are installed in a rotating drum cartridge instead of on a cartridge that follows a reciprocating rectilinear motion. The drum cartridge increases the print speed to between 5 ppM and 20 ppM by using two or more ejection orifices in each printing head of the drum cartridge. Since the drum cartridge does not require a moving carriage to allow for rectilinear motion, the printer can also be miniaturized.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is possible that other benefits or uses of the currently disclosed invention will become apparent over time.

What is claimed is:

1. An ink-jet printer, comprising:

means for loading a sheet of paper into said ink-jet printer;

rotating drum cartridge exhibiting a cylindrical shape, having a plurality of heads alternately located on a surface of said rotating drum cartridge forming a checkered pattern, having a rotation axis perpendicular to the direction of passage of said sheet of paper, and printing on said sheet of paper while moving exclusively in a rotary fashion about said rotation axis;

means for fixing an image onto said sheet of paper; and means for ejecting said sheet of paper from said ink-jet printer.

2. The ink-jet printer of claim 1, further comprised of said head including a slot receiving printing material and orifices ejecting said printing material.

3. The ink-jet printer of claim 1, further comprised of said head having an outlet protruding from said surface of said rotating printing cartridge.

4. The ink-jet printer of claim 1, further comprised of said head including an outlet located on said surface and an inlet located on a different location from said outlet.

5. The ink-jet printer of claim 1, further comprised of a reservoir located into said rotating drum cartridge and connected to said head, containing recording material and supplying said recording material to said head.

6. The ink-jet printer of claim 1, further comprised of said rotating drum cartridge including a heating element.

7. The ink-jet printer of claim 1, further comprised of said plurality of heads having a length similar to both a width of said sheet of paper and a longitudial length of said rotating drum cartridge parallel to said rotation axis.

8. A rotating printing cartridge, comprising:

a shaft having a rotation axis perpendicular to the direction of passage of a sheet of paper; and a plurality of heads alternately located on the surface of said rotating printing cartridge forming a checkered pattern printing on a sheet of paper while rotating about said rotation axis.

9. The rotating printing cartridge of claim 8, further comprised of said head including an inlet receiving recording material and an outlet outputting said recording material.

10. The rotating printing cartridge of claim 8, further comprised of said head including an outlet protruding from said surface of said rotating printing cartridge.

11. The rotating printing cartridge of claim 8, further comprised of said head including an outlet located on said surface and an inlet located on a different location from said outlet.

12. The rotating printing cartridge of claim 8, further comprised of a reservoir connected to said head, containing recording material and supplying said recording material to said head.

13. The rotating printing cartridge of claim 8, further comprised of said head including a heating element.

14. The rotating printing cartridge of claim 8, further comprised of a substrate layer between said head and a reservoir containing recording material.

15. The rotating printing cartridge of claim 8, further comprised of said plurality of heads having a length similar to both a width of said sheet of paper and a longitudinal length of said rotating printing cartridge parallel to said rotation axis.

16. A rotating printing cartridge, comprising:

a shaft having a rotation axis perpendicular to the direction of passage of a sheet of paper; and a plurality of heads positioned on a surface of said rotating printing cartridge, each head including an inlet receiving printing material and an outlet having a different location from said inlet and outputting said printing material.

17. The rotating printing cartridge of claim 16, further comprised of said plurality of heads alternately located on a surface of said rotating printing cartridge forming a checkered pattern.

18. The rotating printing cartridge of claim 16, further comprised of a reservoir located on inside of said rotating printing cartridge containing recording material and supplying said recording material to said inlet of said head.

19. The rotating printing cartridge of claim 16, further comprised of said head including a heating element.

20. The rotating printing cartridge of claim 16, further comprised of said outlet protruding from said surface.

21. The rotating printing cartridge of claim 16, further comprised of said head including at least two orifices.

22. The rotating printing cartridge of claim 16, further comprised of said head including at least two heating element.

23. The rotating printing cartridge of claim 22, further comprised of said heating elements activated alternatively.

24. The rotating printing cartridge of claim 22, further comprised of said heating elements activated at the same time.

25. The rotating printing cartridge of claim 16, further comprised of a substrate layer between said head and a reservoir containing recording material.

26. The rotating printing cartridge of claim 16, further comprised of said plurality of heads having a length similar to both a width of said sheet of paper and a longitudinal length of said rotating printing cartridge parallel to said rotation axis.

27. An ink-jet printer, comprising:

means for loading a sheet of paper into said ink-jet printer;

a rotating drum cartridge exhibiting a cylindrical shape, having a chamber located on inside of said rotating drum cartridge and containing printing material, having a plurality of heads positioned on a surface of said rotating printing cartridge and connected to said chamber for receiving said printing material from said chamber, having a rotation axis perpendicular to the direction of passage of said sheet of paper, and printing on said sheet of paper while moving in a rotary fashion;

means for fixing an image onto said sheet of paper; and means for ejecting said sheet of paper from said ink-jet printer.

28. The rotating printing cartridge, comprising:

a shaft having a rotation axis perpendicular to the direction of passage of a printing medium;

a chamber containing printing material; and a plurality of heads alternately positioned on a surface of said rotating printing cartridge forming a checkered pattern, receiving said printing material and printing on said printing medium while rotating about said rotation axis.

* * * * *